US006632579B1

(12) United States Patent
Yamashita

(10) Patent No.: US 6,632,579 B1
(45) **Date of Patent: *Oct. 14, 2003**

(54) TONER FOR ELECTROPHOTOGRAPHY AND MANUFACTURING METHOD THEREOF

(75) Inventor: Hiroshi Yamashita, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/523,700

(22) Filed: Mar. 13, 2000

Related U.S. Application Data

(62) Division of application No. 09/168,433, filed on Oct. 7, 1998, now Pat. No. 6,140,000.

(30) Foreign Application Priority Data

Oct. 7, 1997 (JP) ..... 09-274542
Oct. 7, 1998 (JP) ..... 10-284649

(51) Int. Cl.[7] ..... G03G 9/097
(52) U.S. Cl. ..... 430/137.11; 430/110.2; 430/137.18
(58) Field of Search ..... 430/137, 110, 430/111, 137.1, 137.11, 110.2, 110.3, 137.18

(56) References Cited

U.S. PATENT DOCUMENTS

| | | | | | |
|---|---|---|---|---|---|
| 4,168,254 | A | * | 9/1979 | Fell | 428/413 |
| 4,620,987 | A | | 11/1986 | Yamashita et al. | 427/131 |
| 4,923,776 | A | * | 5/1990 | Hedvall et al. | 430/137 |
| 5,225,302 | A | | 7/1993 | Isoda et al. | 430/106.6 |
| 5,368,972 | A | | 11/1994 | Yamashita et al. | 430/137 |
| 5,403,690 | A | | 4/1995 | Kuramoto et al. | 430/110 |
| 5,429,900 | A | | 7/1995 | Asanae et al. | 430/110 |
| 5,565,298 | A | * | 10/1996 | Suguro et al. | 430/137 |
| 5,863,696 | A | * | 1/1999 | Koyama et al. | 430/137 |
| 6,074,794 | A | | 6/2000 | Fushimi et al. | |
| 6,103,441 | A | | 8/2000 | Tomita et al. | |
| 6,140,000 | A | | 10/2000 | Yamashita | |
| 6,221,549 | B1 | | 4/2001 | Emoto et al. | 430/120 |
| 6,329,115 | B1 | * | 12/2001 | Yamashita | 430/110.2 |
| 6,335,137 | B1 | | 1/2002 | Suzuki et al. | 430/110.1 |
| 6,360,068 | B1 | | 3/2002 | Kinoshita et al. | 399/284 |
| 6,363,229 | B1 | | 3/2002 | Shiraishi et al. | 399/68 |
| 6,395,443 | B2 | | 5/2002 | Kuroda et al. | 430/110.4 |
| 6,403,275 | B1 | | 6/2002 | Kuramoto et al. | 430/111.4 |
| 6,432,589 | B1 | | 8/2002 | Uchinokura et al. | 430/18 |
| 6,468,706 | B2 | | 10/2002 | Matsuda et al. | 430/108.6 |

FOREIGN PATENT DOCUMENTS

| | | | | |
|---|---|---|---|---|
| GB | 2081921 | * | 2/1982 | 430/137 |
| JP | 3-116054 | * | 5/1991 | 430/110 |
| JP | 4-90558 | * | 3/1992 | 430/110 |

OTHER PUBLICATIONS

ACS File Registry RN 12237–22–8 Copyright 2000.*

US Patent & Trademark Office English–Language Translation of JP 3–116054 CPub May 1991), pp 1–12.*

US Patent & Trademark Office English–Language Translation of JP 4–090558 (Pub Mar. 1992), pp 1–27.*

Derwent Abstracts, AN 98–366887, JP 10–142838, May 29, 1998.

* cited by examiner

*Primary Examiner*—Janis L. Dote
(74) *Attorney, Agent, or Firm*—Oblon, Spivak, McClelland, Maier & Neustadt, P.C.

(57) ABSTRACT

A toner for electrophotography comprises a resin, a colorant and a charge controlling agent, wherein the charge controlling agent is substantially present on a surface part of the toner, and wherein the toner has a saturated charge quantity (absolute value) of from about 10–40 $\mu$C/g when the toner is mixed with a carrier which is coated with a silicone resin, and a carrier contamination degree not greater then about 20%.

8 Claims, 1 Drawing Sheet

TONER FOR ELECTROPHOTOGRAPHY AND MANUFACTURING METHOD THEREOF

This application is a Divisional of application U.S. Ser. No. 09/168,433 filed on Oct. 7, 1998, issued as U.S. Pat. No. 6,140,000.

BACKGROUND OF THE INVENTION

1. Field of the Invention

The present invention relates to a toner which is useful for electrophotography and the like, and to a method for manufacturing the toner.

2. Discussion of the Background

Currently, with the rapid digitalization in electrophotography, there is a steadily increasing need for a developer which can reproduce images having good image qualities. In addition, full color copiers and printers for the production of color images are in rapid increasing demand, because of the increase in demand for the preparation of color documents which are used for various presentations and for the reproduction of digital color images prepared by computers, digital cameras and scanners. Further, since computers are widely used in small offices and in home offices, attempts to miniaturize these image forming apparatuses and to reduce the costs thereof have been made. Furthermore, in order to save materials and avoid environmental pollution, recycling of these apparatuses and their supplies has been attempted. However, with the current state of the art, high-functional toners, which can produce good images, generally have poor reliability and, therefore, good images cannot be continuously produced over a long period of time.

The toners which are used in electrophotography are generally manufactured by the following method in which (1) a melted resin is mixed with additives such as a colorant, a charge controlling agent and the like, to disperse the additives in the resin; (2) the mixture is cooled; (3) the mixture is pulverized using high-speed air; and (4) the pulverized mixture is classified to obtain a toner having a proper particle diameter distribution.

In general, although the colorant is finely dispersed in the resin, the charge controlling agent is dispersed in the resin with relatively large particle diameter in comparison to the colorant. In addition, since the charge controlling agent is generally poorly compatibile with the resin, the charge controlling agent tends to easily separate from the resin upon pulverization. Therefore, the charge controlling agent often adheres to and contaminates the inside of the pulverizer. Further, the free charge controlling agent tends to transfer to the surface of the resultant toner, which results in a toner which does not have uniform charge properties. When the thus manufactured toner is used for a long time in an electrophotographic image forming apparatuses such as a copier or printer, the charge controlling agent easily releases from the toner and contaminates the developing units and other units of the apparatuses and carriers of the developers in the developing units; thereby resulting in deterioration of image quality.

The charge properties of a toner largely depend on the materials of the surface part of the toner. In other words, the charge controlling agent, which is dispersed inside the toner, has little affect on the charge properties of the toner. In addition, charge controlling agents are generally expensive. Therefore, a need exists for charge controlling agents which are preferably included on only the surface part of toners.

In attempting to solve these problems and in order to fulfill the need, Japanese Laid-Open Patent Publication No. 55-28032 discloses a magnetic toner in which fine particles consisting of a charge controlling agent are contacted with the surface of the toner at a high temperature, while a flow of air is supplied to fix the charge controlling agent to the toner surface. However, since the treatment is performed at a high temperature, a problem which occurs is that toner particles adhere to each other, resulting in formation of aggregates of the toner particles, and in addition a problem occurs in that the resultant toner has uneven charge properties, because the charge controlling agent cannot uniformly cover the surface of the toner. In addition, the fine particles cannot be entirely fixed on the surface of the toner and, therefore, the charge controlling agent is easily released from the toner by mechanical external forces.

Japanese Laid-Open Patent Publication No. 63-244056 discloses a toner which is manufactured by impacting colored particles with charge controlling particles and then passing the colored particles through a narrow space to fix the charge controlling particles thereon. However, a problem of the resultant toner is that the toner has uneven charge properties, because the covering of the charge controlling particles on the surface of each toner particle is not uniform and in addition the charge controlling particles fixed on the toner are easily released from the toner when the toner is mechanically mixed with a carrier, or rubbed with toner charging blades or toner layer regulating blades in developing units of image forming apparatuses.

In order to obtain images having good image qualities such as high resolution, attempts have been made to improve toners by preparing toners of relatively small average particle diameter and/or a narrow particle diameter distribution. However, toner particles manufactured by pulverization have irregular shapes, and when the toner particles are mixed with carriers and stirred in developing units, and/or rubbed with toner layer regulating blades or charging blades, the toner is further pulverized, thereby resulting in superfine toner particles and deterioration of image qualities. In addition, since the toner particles have an irregular shape, the toner exhibits poor fluidity and, therefore, the toner needs a large amount of a fluidizing agent. Another problem which occurs is that the filling factor of a toner bottle is relatively small, resulting in difficulties with miniaturization of toner bottles and image forming apparatuses.

Further image transfer processes for forming full color images in which full color images, which are formed on a photoconductor, are transferred to a transfer medium or a paper sheet are becoming more and more complex. Since the toner, which is manufactured by pulverization and, therefore, has an irregular shape, has poor transferability, a problem which tends to occur in that a portion of the transferred image is omitted, and when attempting to solve this problem, another problem occurs is that toner consumption increases.

Therefore, the need has increased for a toner which can produce images having good image qualities with small toner consumption, which results in decreases of running costs, by improving the transferability of the toner.

When a toner has good transferability, a toner cleaning device is not necessary for an image forming apparatus because almost all the toner images which form on a photoconductor or on an intermediate transfer medium are transferred to a transfer sheet and, therefore, miniaturization and cost reduction of image forming apparatus are possible and further the apparatus have an advantage in that disposal of waste toner is not needed.

In attempting to improve these drawbacks of toners having an irregular shape, a variety of methods have been proposed for manufacturing spherical toners.

For example, a particulate toner has been proposed which is manufactured by a suspension polymerization method in which oil drops, which include a monomer and toner property forming agents such as a colorant and which are dispersed in water are polymerized to form the particulate toner. The resultant toner is spherical and, therefore, the toner represents an improvement over the toner which has an irregular shape to some extent. However, it is difficult by the suspension polymerization method to obtain a toner having good transferability and cleaning properties by controlling its shape, for example, so as to have an intermediate shape between a spherical shape and an irregular shape.

In suspension polymerization, the conversion rate of monomer to polymer is preferably maximized and, therefore, it takes a long time to prepare the polymer. In addition, after the polymerization process and the following separation of the toner from water, the water and monomers which remain in the polymerized toner have to be removed from the toner. The removal of monomers is particularly difficult because monomers do not easily evaporate. On the other hand, toner particles generally melt and adhere to each other when dried at a temperature of 100° C. or even lower. Therefore, toner particles are preferably dried at a temperature as low as possible, or vacuum drying is used to removing monomers from toner particles. Even when vacuum drying is performed at a relatively low temperature, a long time is required to remove monomer from toner particles, which results in increases in the manufacturing costs of the polymerized toner. In addition, when the toner particles are insufficiently dried, the toner particles adhere to each other when preserved at a relatively high temperature, resulting in the occurrence of blocking of the toner particles, or even if the toner particles do not adhere to each other, the monomer which remains in the toner particles seeps onto the surface of the toner particles, resulting in changes in the charge properties of toner and, therefore, the deterioration of image quality.

Further, since the particle diameter of polymerized toners is relatively small, a large amount of dispersant such as surfactant, inorganic particulate dispersant or water-soluble polymer protective colloid is needed for manufacturing the polymerized toners, which is different from general suspension polymerization. The dispersant tends to remain on the surface of the toner, resulting in deterioration of the charge properties of the resultant toner particularly under high humidity conditions. In order to remove these surfactants, the toner particles are preferably washed with a large amount of water for a long time. In this case, a large facility for treating waste water is needed, resulting in increases in manufacturing costs.

Furthermore, in suspension polymerization, which can be considered to be microbulk polymerization, it is difficult to control the average molecular weight and molecular weight distribution of the resultant polymer. These factors are important in the preparation of full color toners. Transparency and smoothness are important image qualities for full color images. When resins, which are used for the production of full color toner have too a high molecular weight, the color images produced by the resultant toners do not have the desired transparency and smoothness when the images are fixed by conventional heat energy. Low molecular weight polyesters, which have good fixability, cannot be prepared by condensation polymerization in water and, therefore, they are not available for suspension-polymerized toners.

Colorants such as pigments for use in the toner cannot be finely dispersed in monomers without dispersants. When a dispersant is used in such an amount that the resultant toner has good color properties, the charge properties of the toner are adversely affected to some extent by the dispersant. In addition, when the pigments are hydrophilic, the pigments move to the surface of the toner particles during polymerization, resulting in deterioration in the dispersion of the pigments. Accordingly, toners having good color properties and toner properties cannot be obtained. Thus the suspension polymerized spherical toners have a variety of problems as mentioned above.

Spherical toners can be obtained by another method in which a solution including a toner is formed as drops in water. In detail, at first toner materials such as a resin, a colorant and the like are dissolved or dispersed in an organic solvent to prepare a toner liquid, and then the toner liquid is mixed into water to prepare an emulsion including the liquid toner particles, and finally the water and the organic solvent are dried to prepare toner particles. In this method, spherical toner particles can be obtained, however, the shape of the toner particles cannot be controlled, which is the same drawback as that of the polymerized toner.

In addition, this method has a drawback in that the organic solvent which is used to dissolve the resin cannot be easily removed from the toner particles. The solvent tends to remain in the toner particles in a greater amount than the monomers in the case of the polymerized toners. Therefore, the toner particles are so tacky during drying that the particles adhere to each other, resulting in formation of aggregates of the toner particles. Even when an organic solvent having a low boiling point is used as the solvent, it takes a long time to remove (dry) the solvent from inside of the toner particles. If the drying is insufficient, the preservability and charge properties of the resultant toner are seriously affected. In addition, upon drying, voids tend to form as a result of evaporation of the solvent from the toner particles. Consequently, the resultant toner particles easily brake. The broken toner particles have too small a particle diameter to produce good images. Further, since a large amount of solvent is needed to manufacture the toner particles, an additional process and a facility for recycling the solvent are needed, resulting in increases in manufacturing costs.

In order to stabilize the drops of the liquid toner particles, a dispersant is needed. When a dispersant is used, a problem tends to occur which is similar to the problem of polymerized toner and, therefore, an additional process and a facility for washing the resultant toner particles are needed, resulting in increases of manufacturing costs. When self-emulsifying resins are used as the toner resin, it is possible to reduce the amount of the dispersant added or to remove the dispersant from the toner liquid. However, the self-emulsifying resins tend to locate on the surface of the toner particles and, therefore, the charge properties of the toner deteriorate.

The resin which is used in this toner manufacturing method is limited to resins which can be dissolved in organic solvents which are not dissolvable in water, although the number of the resins is not as small as the number of resins which are used in the polymerized toner.

In this toner manufacturing method, it is often difficult to disperse a colorant in a resin solution, because the colorant such as a pigment does not always adsorb the resin. When a dispersant is used, a similar problem to that of the polymerized toner occurs and also the charge properties of the resultant toner deteriorates.

In Japanese Laid-Open Patent Publication No. 10-142838, the present inventor discloses a toner for electrophotography which contains very little volatile organic component and a free fluidizing agent and whose shape can be controlled. A method is also disclosed for manufacturing the toner in which the primary particles of the toner are dispersed in a liquid which does not dissolve the resin and in which the particles are heated for an extremely short time to control the toner particles. In addition, the publication discloses that by using this method a charge controlling agent can be securely fixed on the surface of the toner particles, resulting in prevention of deterioration of the charge properties of the resultant toner. The present invention further improves the release of the charge controlling agent from the toner particles, which causes contamination of carriers and developing units used for producing images.

SUMMARY OF THE INVENTION

Accordingly, one object of the present invention is to provide a toner for electrophotography which maintains good charge properties even when used for a long time.

Another object of the present invention is to provide a toner which can produce images having good image qualities without fogging or omissions in recorded character images.

Yet another object of the present invention is to provide a method in which the toner can be manufactured by continuous processes at low manufacturing cost.

Briefly these objects and other objects of the present invention as hereinafter will become more readily apparent can be attained by a toner in which a charge controlling agent is present on the surface part of the toner, and which has a saturated charge quantity (absolute value) of from about 10 to about 40 $\mu$C/g when the toner is mixed with a silicone coated carrier, and a carrier contamination degree not greater than about 20%.

The toner of the invention preferably has an average spherical degree of from 100 to about 120.

The charge controlling agent preferably includes at least two charge controlling agents one of which results in the toner having an initial charging speed (absolute value) not less than about 10 $\mu$C/g min and the other of which results in the toner having a charge stability coefficient not greater then about 50%.

In another aspect of the present invention, a method for manufacturing the toner is provided which comprises the steps of:

preparing primary particles comprising at least a resin and a colorant;

dispersing the particles in a liquid which does not dissolve the resin and which contains a dispersant;

heating and then cooling the dispersion to form toner particles;

optionally washing the dispersion; and drying the dispersion to prepare a toner, wherein a composition comprising a charge controlling agent is added to the dispersion at a time before the heating, during the heating, after the cooling or after the washing of the particles.

BRIEF DESCRIPTION OF THE DRAWINGS

Various other objects, features and attendant advantages of the present invention will be more fully appreciated as the same becomes better understood from the detailed description when considered in connection with the accompanying drawing in which like reference characters designate like corresponding parts throughout and wherein.

DETAILED DESCRIPTION OF THE PREFERRED EMBODIMENTS

Figure 1:
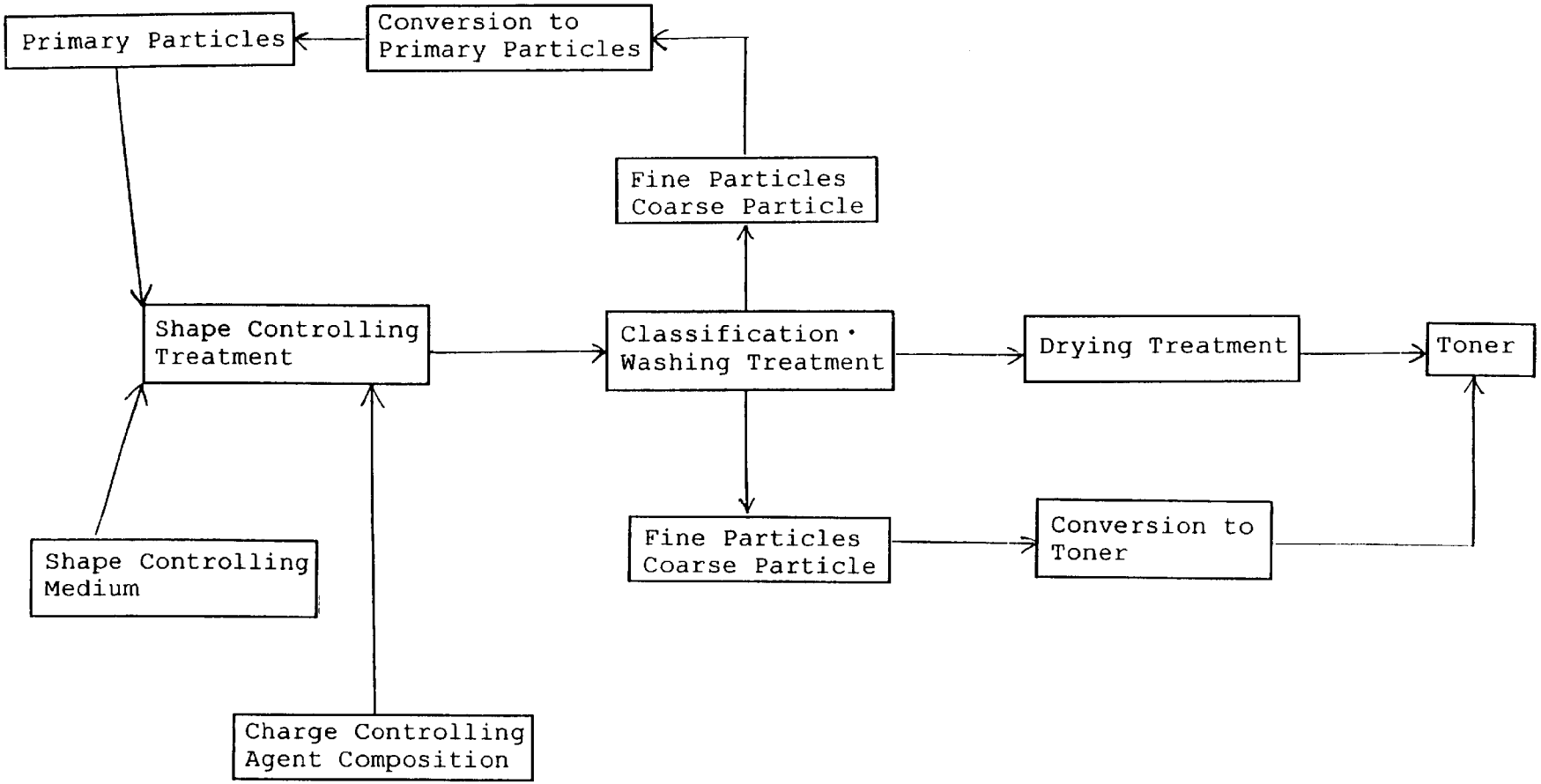
FIG. 1 is a flowchart showing process steps of the toner manufacturing method of the present invention.

Generally, the present invention provides a toner in which a charge controlling agent is present on the surface of the toner, and which has a saturated charge quantity (absolute value) of from about 10 to about 40 $\mu$C/g, and a carrier contamination degree not greater than about 20%. By controlling the saturated charge quantity of the toner to within the range from about 10 to about 40 $\mu$C/g, images having good image qualities such as good image density and good half tone reproducibility without background fouling can be obtained.

Since the charge controlling agent is present on the surface of the toner particles, the resultant toner can maintain good charge properties for a long time even when a small amount of the charge controlling agent is used for the toner. By controlling the carrier contamination degree to not greater than about 20%, the carrier to be mixed together with the toner can maintain good charging ability because the carrier is hardly contaminated by the toner.

The following method can be used to determine whether a charge controlling agent is present on the surface part of a toner particle and the quantity of the charge controlling agent on the surface part of the toner particle. That is, the surface of a toner particle is analyzed by checking the WDX spectrum intensity of one or more specific elements such as zinc, fluorine, chromium and the like by electron probe microanalysis (EPMA). In this connection, it is noted that the term "the surface part" means the surface layer of a toner particle between the surface of the particle and points about 1 um deep in the particle.

On the other hand, the presence of a controlling agent inside a toner particle can be determined, for example, by one or more of the following methods:

(1) observing a toner particle, which is cut into an ultrathin section, with a transmittance electron microscope (TEM); and (2) removing a charge controlling agent present on the surface of a toner particle by placing the toner particle in a solvent which can dissolve the charge controlling agent but cannot dissolve the toner resin, and then determining the quantity of an element, which is included in the charge controlling agent, in the toner particle.

The carrier contamination degree of a toner is determined by the following toner charging test:

(1) mixing a toner and a carrier in a predetermined ratio to prepare a developer;

(2) stirring the developer while measuring the charge quantity of the toner at regular intervals (preferably 10 minutes or less) with a blow-off type charge measuring apparatus, to determine the saturated charge quantity and the stirring time needed to reach the level of saturation of the charge quantity of the toner, i.e., the charge saturation time, wherein the term "saturation" means that the ratio of $(Qn+1-Qn)/Qn$ is not greater than 20%, wherein Qn is the charge quantity of the toner at the "n"th measurement;

(3) removing the toner from the carrier to prepare the used carrier;

(4) mixing a new toner with the used carrier and stirring the combination to measure the saturated charge quantity of the toner, and then removing the toner from the carrier;

(5) repeating operation (4) three more times (five times in total); and (6) determining the carrier contamination degree by the following equation:

$$\text{Carrier contamination degree } (\%)=100\times|(Q/m(1)-Q/m(5))|/|Q/m(1)|$$

wherein Q/m(1) is an initial charge quantity per unit weight of the toner and Q/m(5) is a charge quantity per unit weight of the toner in the fifth toner charging test.

Measurements of the charge quantity by the blow-off type of charge measuring apparatus is performed as follows:

(1) setting a developer including a toner and a carrier on a sieve;

(2) blowing off the toner with air to separate the toner from the carrier; and (3) weighing the toner blown off (m) (gram) with a balance and measuring the charge (Q) (coulomb) of the toner with a Q meter, thereby obtaining a value of Q/m for the toner.

The mixing ratio of toner to carrier, which is determined based on the toner quantity needed to cover the carrier, is typically from 1–10%. Mixing and stirring are performed by placing the toner and the carrier into a stainless pot and rotating the pot using a ball mill stand.

In the present invention, carriers in which a core material such as ferrite or magnetite is coated with a silicone resin such as crosslinked polydimethylsiloxane are preferably used. In order to optimize the charge quantity of the toner to within the range of 10–40 $\mu$C/g, modified silicone resins having a functional group such as an amino group or a carboxyl group are preferably used.

The average spherical degree of the toner particles can be measured as follows:

(1) observing the shape of many particles of a toner with a scanning type electron microscope;

(2) analyzing the particle images with a marketed image analyzing apparatus or a flow type particle image analyzing apparatus such as FPIA-1000 manufactured by Sysmex Co.; and (3) obtaining the average spherical degree of the particles by the following equation:

$$\text{Average spherical degree}=100\bullet\Sigma(Li^2/4\bullet\Pi\bullet Si)/N$$

wherein Li represents the girth of a particle image, Si represents the area of the particle image and N represents the number of evaluated particles.

The average spherical degree is preferably obtained using an FPIA-1000 device manufactured by Sysmex Co. This apparatus can take a couple of thousand particles dispersed in a liquid and analyzes the particle images and the properties of the particles.

Toners having an average spherical degree of from 100 to about 120 tend not to be broken even when stirred in a developing unit, and have good fluidity and high transfer efficiency. Therefore, the toners can produce images having good image qualities without fogging or omissions in recorded character images.

If the cleaning properties of a toner, which has a substantially true spherical shape, are not satisfactory, because the toner tends to pass through a cleaning blade, the shape of the toner particles can be slightly deformed to overcome this problem.

If the average spherical degree is from 100–120, external additives are not needed, or the addition of a small amount of external additives allows the toner to have good fluidity. In addition, images having good reproducibility without omissions in recorded character and/or line images can be obtained.

The toner of the present invention includes toners which have a charge controlling agent on the surface part of the toner particles. By using such a toner, images having good image qualities without fogging or omissions in the recorded character images can be obtained. Namely, by using such a toner, adverse effects caused by charge controlling agents such as deterioration of the fixability or color properties of toner can be avoided. In general, a color toner requires a colorless charge controlling agent, because a colored charge controlling agent makes a toner darkly colored. By using a small amount of a colored charge controlling agent, which has excellent charge controlling ability, on a color toner, a good color toner can also be obtained. In this case, since a small amount of a charge controlling agent is used, a low-cost toner can be obtained.

In particular, when a charge controlling agent (a) which can impart an initial charging speed (absolute value) not less then about 10 $\mu$C/g•min to the toner and a charge controlling agent (b) which can impart a charge stability coefficient not greater than about 50% to the toner are included on the surface part of toner particles, the resultant toner can maintain good charge stability and has good charge increasing properties in initial charging.

The charge stability coefficient is determined as follows:

(1) mixing a toner and a carrier in a predetermined ratio to prepare a developer;

(2) measuring a saturated charge quantity Q/m(s) by the method mentioned above;

(3) measuring a charge quantity Q/m(3H) of the toner after stirring the developer for 3 hours;

(4) determining the charge stability coefficient by the following equation:

$$\text{Charge stability coefficient}=100\bullet|(Q/m(s)-Q/m(3H))|/Q/m(s)|$$

Charge controlling agents which impart a charge stability coefficient of not greater than about 50% to the toner are preferably used as charge controlling agent (b). In the event the charge quantity of a toner is not saturated when the toner is stirred for 3 hours, the charge stability coefficient of the toner could not be determined.

Charge controlling agents for use as the charge controlling agent (a) mentioned above include metal salts or metal complexes of aromatic type organic acids. Specific examples of such compounds include salts or complexes of a metal such as Na, Mg, Al, K, Ca, Cr, Fe, Co, Ni, Cu and Zn of benzoic acid derivatives and aromatic dicarboxylic acids, each of which have a functional group such as an alkyl group or a hydroxy group, e.g., salicylic acid, isophthalic acid derivatives, terephthalic acid derivatives, phthalic acid derivatives and naphthoic acid derivatives.

Charge controlling agents for use as the charge controlling agent (b) mentioned above include quaternary ammonium salts having a perfluoroalkyl group. Specific examples of such compounds include the following compounds.

$$C_8F_{17}SO_2NH(CH_2)_3N^+(CH_3)_3\ X^- \quad (1)$$

-continued (2)

$C_9F_{19}CONH(CH_2)_3N^+(CH_3)_3\ X^-$ (3)

$C_8F_{17}SO_2NH(CH_2)_3N^+(CH_3)_3\ X^-$ (4)

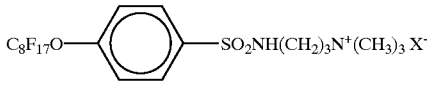

(5)

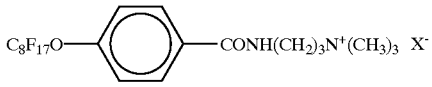

(6)

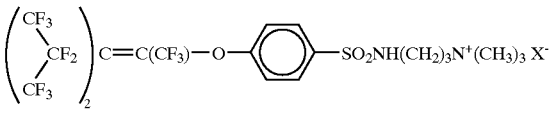

(7)

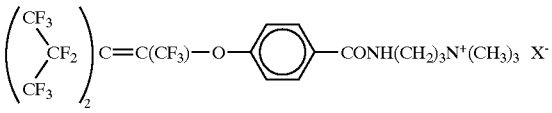

(8)

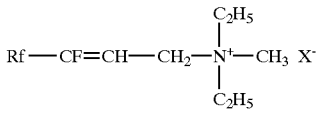

$Rf = C_5F_{11}\sim C_{11}F_{23})$ (9)

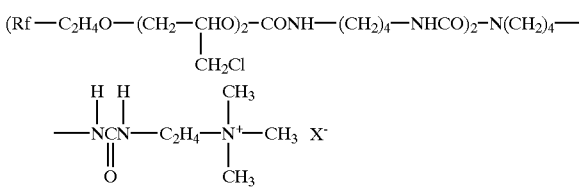

$(Rf = C_8F_{17}\sim C_{16}F_{33})$ (10)

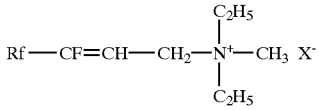

$(Rf = C_5F_{11}\sim C_{11}F_{23})$ (11)

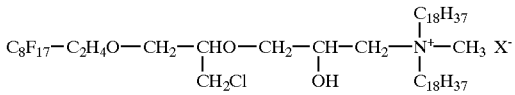

(12)

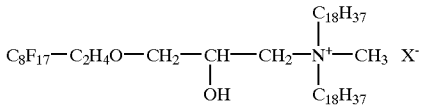

(13)

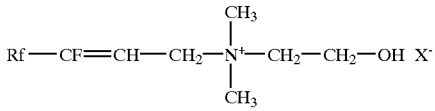

$(Rf = C_3F_4\sim C_{16}F_{23})$

In the formulas described above, $X^-$ represents an organic or inorganic anion. Specific examples of such an anion include $Cl^-$, $Br^-$, $I^-$, $PF_5^-$, sulfate, phosphate, cyanate, thiocyanate, $BF_4^-$ $B(aryl)_4^-$ such as tetraphenyl borate, p-chlorotetraphenyl borate, p-methyltetraphenyl borate and tetranaphthyl borate; phenolate, nitrophenolate, zinc tetracyanate, zinc tetrathiocyanate, $CH_3OSO_3^-$, saturated or unsaturated aliphatic or aromatic carboxylate or sulfonate such as acetate, lactate, benzoate, salicylate, 2-hydroxy-3-naphthoate, 2-hydroxy-6-naphthoate, ethylsulfonate and phenylsulfonate; and perfluoro saturated or unsaturated aliphatic or aromatic carboxylate or sulfonate such as perfluoroacetate, perfluoroalkylbenzoate, perfluoroethylsulfonate and perfluoroalkylbenzoate.

In addition, when the content of each of the charge controlling agents (a) and (b) in a toner is not greater than 1%, the provability that charge controlling agents can contact carrier particles increases, because the spherical shape of the toner particles is such that any point on the surface of the toner particles can contact the carrier. Therefore, the resultant toner can maintain good and stable charge properties for a long time.

In addition, by including a charge controlling agent on the surface part of toner particles, the amount of the charge controlling agent (b) used, which is expensive because of the presence of an expensive group such as a perfluoro group, can be reduced.

Further, by incorporating a charge controlling agent in the toner particles in an amount of not greater than about 1%, fogging and omissions in transferred character images can be avoided and in addition, the fixability of recorded images can be improved and deterioration of color properties of color toners can be decreased to the utmost.

Charge controlling agents are typically used in conventional toners in an amount of a few percent by weight in toner particles. In contrast, the present toner provides an advantage of not requiring more than about 1% by weight of charge controlling agent in the toner particles. More preferably, the charge controlling agent content is not greater than about 0.5% by weight, which still allows good toner performance without contamination of developing elements.

Hereinafter materials which can be incorporated into the toner of the present invention are detailed.

Suitable colorants for use in the toner of the present invention include carbon black, Nigrosine dyes, aniline blue, chalco oil blue, Chrome Yellow, ultramarine blue, Oil Red, Quinoline Yellow, methylene blue chloride, Phthalocyanine Blue, Malachite Green oxalate, lamp black, Rose Bengale, xanthene type pigments, benzidine type yellow organic pigments, quinacridone type organic pigments, methine type organic pigments, thioindigo type organic pigments, azo lake type organic pigments, mixtures of these pigments and dyes, and the like.

Suitable charge controlling agents for use in the toner of the present invention, other Ag than the charge controlling agents (a) and (b), include BONTRON 03 (Nigrosine dyes), BONTRON P-51 (Quaternary ammonium salts), BONTRON S-34 (metal-containing azo dyes), E-82 (oxynaphthoic acid type metal complex), E-84 (salicyclic acid type metal complex) and E-89 (phenol type condensation products), which are manufactured by Orient Chemical Industries Co., Ltd.; TP-302 and TP-415 (quaternary ammonium salts molybdenum complex), which are manufactured by Hodogaya Chemical Co., Ltd., Copy Charge PSY VP2038 (quaternary ammonium salts) Copy Blue PR (triphenylmethane derivatives), Copy Charge NEG VP2036 (quaternary ammonium salts) and Copy Charge NX VP434 (quaternary ammonium salts), which are manufactured by Hoechst AG; LRA-901 and LR-147 (boron complex), which are manufactured by Japan Carlit Co.; copper Phthalocyanine; perylene; quinacridone; azo type pigments; and polymer compounds having a functional group such as sulfonic acid group, a carboxyl group or a quaternary ammonium salt group.

In order to impart releasability properties to the toner of the present invention, a wax is preferably included in the toner.

Waxes having a melting point of from about 40 to about 120° C., and preferably from about 50 to about 110° C., are preferably used for imparting good fixability properties to the toner at low temperatures, good resistance to offset and good durability.

The melting point of waxes can be determined by the differential scanning calorimeter (DSC) method. Namely, a few milligram sample of the wax is treated at a constant heating speed, for example, 10° C./min, and the temperature at which the heat of melting has a peak value is defined as the melting point.

Specific examples of such waxes include solid paraffin waxes, micro waxes, rice waxes, fatty acid amide waxes, fatty acid waxes, aliphatic monoketones, fatty acid metal salts type waxes, fatty acid ester type waxes, partially saponified fatty acid ester type waxes, silicone varnishes, higher alcohols, carnauba wax and the like. In addition, low molecular-weight polyolefins such as polyethylene and polypropylene can also be used. In particular, polyolefins having a softening point (measured by a ring and ball method) of from about 70 to about 150° C., and preferably from about 120 to about 150° C., are preferred.

Suitable fluidizing agents for use in the toner of the present invention include inorganic fine particles. The primary particle diameter of the inorganic fine particles is preferably about 5 nm to about 2 um, and more preferably about 5 nm to about 500 nm.

The specific surface area of the inorganic particles, which is determined by the BET method, preferably ranges from about 20 to about 500 $m^2/g$. The content of the fine inorganic particles in the toner preferably ranges from about 0.01 to about 5% by weight, and more preferably from about 0.01 to about 2.0% by weight.

Specific examples of such particles include silica, alumina, titanium oxide, barium titanate, magnesium titanate, calcium titanate, strontium titanate, zinc oxide, silica sand, clay, mica, wollastonite, diatomite, chromium oxide, cerium oxide, red iron oxide, antimony trioxide, magnesium oxide, zirconium oxide, barium sulfate, barium carbonate, calcium carbonate, silicon carbide, silicon nitride and the like.

By subjecting these fluidizing agents to a surface treatment to improve the hydrophobic properties thereof, deterioration of the fluidity and the charge properties of the toner can be avoided even under high humidity conditions. Suitable surface treating agents include silane coupling agents, silane coupling agents having a fluorinated alkyl group, organic titanate type coupling agents, aluminum type coupling agents and the like.

Cleaning property improving agents for use in the toner of the present invention include fatty acids and their metal salts such as stearic acid, zinc stearate and calcium stearate, and particulate polymers such as polymethyl methacrylate particles and polystyrene particles which are manufactured, for example, by the soap-free emulsion polymerization method.

The toner of the invention may be used as a non-magnetic toner or a magnetic toner. When a magnetic toner is prepared, magnetic particles are simply blended with the toner. Specific examples of such magnetic particles include ferromagnetic metals such as iron, nickel and cobalt, alloys of the ferromagnetic metals, and compounds including one or more ferromagnetic metals such as ferrite and magnetite; and alloys, which do not include a ferromagnetic metal but exhibit a ferromagnetic property when they are properly subjected to heat treatment, such as Heusler's alloys, e.g., manganese copper-aluminum and manganese copper-tin, and chromium dioxide; and the like. Among these materials, ferrite and magnetite are preferred.

Preferably, the magnetic particles having a fine average particle diameter of from about 0.1 to about 1 $\mu$m are uniformly dispersed in the toner. The content of the magnetic particles in the toner preferably ranges from about 10 to about 70 parts by weight, and more preferably from about 20 to about 50 parts by weight, per 100 parts by weight of the toner.

Dispersants for use in the preparation of the toner of the present invention, which impart wettability properties to primary particles for liquids including water, in order to disperse the toner particles therein include anionic surfactants such as alkylbenzenesulfonic acid salts, $\alpha$-olefin sulfonic acid salts and phosphoric acid esters; cationic surfactants such as amine salts, e.g., alkyl amine salts, aminoalcohol derivatives with fatty acids, polyamine derivatives with fatty acids and imidazoline, and quaternary ammonium type surfactants, e.g., alkyltrimethylammonium salts, dialkyldimethylammonium salts, alkyldimethylbenzyl ammonium salts, pyridinium salts, alkylisoquinolium salts, alkyldimethylammonium salts and benzethonium chloride; nonionic surfactants such as fatty acid amide derivatives and polyhydric alcohols; and amphoteric surfactants such as alanine, dodecyldi(aminoethyl)glycine, di(octylaminoethyl)-glycine, and N-alkyl-N,N-dimethylammoniumbetaine.

When surfactants having a fluoroalkyl group are used, they can exert their effects in only very small amounts.

Suitable anionic surfactants having a fluoroalkyl group include fluoroalkylcarboxylic acids having from 2–10 carbon atoms and their metal salts, perfluorooctanesulfonylglutamic acid disodium salt, 3-[$\omega$-fluoroalkyl($C_6$–$C_{11}$)oxy]-1-alkyl($C_3$-$C_4$)sulfonic acid sodium salts, 3-[(-fluoroalkanoyl($C_6$–$C_8$)-N-ethylamino]-1-propanesulfonic acid sodium salts, fluoroalkyl($C_{11}$–$C_{20}$)carboxylic acids and their metal salts, perfluoroalkylcarboxylic acids ($C_7$–$C_{13}$) and their metal salts, perfluoroalkyl($C_4$–$C_{12}$)sulfonic acid and their metal salts, perfluorooctanesulfonic acid diethanolamide, N-propyl-N-(2-hydroxyethyl) perfluorooctanesulfonamide, perfluoroalkyl($C_6$–$C_{10}$) sulfoneamidopropyl trimethylammonium salts, perfluoroalkyl($C_6$–$C_{10}$)-N-ethylsulfonylglycine salts, and monoperfluoroalkyl($C_6$–$C_{16}$)ethylphosphoric acid esters.

Tradenamed anionic surfactants having a perfluoroalkyl group include SURFLON S-111, S-112, and S-113 (manufactured by Asahi Glass Col, Ltd.), FLORARD FC-93, Ec95, FC-98 and FC-129 (manufactured by Sumitomo 3M Ltd.), UNIDINE DS-101 and DS-102 (manufactured by Daikin Co., Ltd.), MEGAFAC F-110, F-120, F-113, F-19 1, F-812 and F-833 (manufactured by Dainippon Ink and Chemicals, Inc.); EKTOP EF-102, 103, 104, 105, 112, 123A, 123B, 306A, 501, 201 and 204 (manufactured by Tochem Products Co., Ltd.), and PHTHARGENT F-100 and F-150 (manufactured by Neos co., Ltd.).

Suitable cationic surfactants having a fluoroalkyl group include primary, secondary or tertiary aliphatic amine salts; aliphatic amine salts; aliphatic quaternary ammonium salts such as perfluoroalkyl ($C_6$–$C_{10}$) sulfonamidopropyltrimethylammonium salts; benzalkonium salts; benzethonium chloride; pyridinium salts; and imadazolinium salts. Tradenamed cationic surfactants include SURFLON S-121 (Asahi Glass Co., Ltd.), FLORARD FC-135 (manufactured by Sumitomo 3M Ltd.), UNIDINE DS-202 (manufactured by Daikin Co.), MEGAFAC F-150 and F-824 (Dainippon Ink and Chemicals Inc.), EKTOP EF-132 (manufactured by Tochem Products Co., Ltd.), and PHTHARGENT F-300 (manufactured by Neos Co., Ltd.).

In addition, dispersants of inorganic compounds, which are hardly soluble in water, such as tricalcium phosphate, calcium carbonate, titanium oxide, colloidal silica, and hydroxyapatite can also be employed.

In addition, primary particles can be stabilized with polymer type protective colloids. Specific examples of such polymer type protective colloids include homopolymers and copolymers of the following compounds:

acids such as acrylic acid, methacrylic acid, α-cyanoacrylic acid, α-cyanomethacrylic acid, itaconic acid, crotonic acid, fumaric acid, maleic acid, and maleic anhydride;

(meth)acrylic monomers such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic acid esters, diethylene glycol monomethacrylic acid esters, glycerin monoacrylic acid esters, glycerin monomethacrylic acid esters, N-methylol acrylamide, and N-methylol methacrylamide;

vinyl alcohol, ethers such as vinyl methyl ether, vinyl ethyl ether and vinyl propyl ether, and compounds having a carboxyl group such as vinylacetate, vinylpropionate and vinyl butyrate;

amides such as acrylamide, methacrylamide, diacetoneacrylamide, and their methylol compounds;

acid chloride compounds such as acrylic acid chloride, and methacrylic acid chloride; and compounds having a nitrogen atom or a heterocyclic ring including a nitrogen atom such as vinyl pyridine, vinyl pyrrolidone, vinyl imidazole and ethylene imine.

The following polymers can be used as protective colloids:

polyoxyethylene compounds such as polyoxyethylene, polyoxypropylene, polyoxyethylenealkylamine, polyoxypropylenealkylamine, polyoxyethylenealkylamide, polyoxypropylenealkylamide, polyoxyethylenenonylphenylether, polyoxyethylenelaurylphenylether, polyoxyethylenestearylphenylether, and polyoxyethylenenonylphenylether; and cellulose compounds such as methyl cellulose, hydroxyethyl cellulose, and hydroxypropyl cellulose.

Suitable resins for use in the toner of the present invention include polymers which are obtained by polymerizing one or more monomers including at least a monomer selected from the group consisting of styrene type monomers, (meth) acrylic monomers and (meth)acrylic ester monomers. Specific examples of such styrene type monomers include styrene, o-methylstyrene, m-methylstyrene, p-methylstyrene, α-methylstyrene, p-ethylstyrene, 2,3-dimethylstyrene, 2,4-dimethylstyrene, p-n-butylstyrene, p-t-butylstyrene, p-n-hexylstyrene, p-n-octylstyrene, p-n-nonylstyrene, p-n-decylstyrene, p-n-dodecylstyrene, p-methoxystyrene, p-phenylstyrene, p-chlorostyrene and 3,4-dichlorostyrene.

Specific examples of the acrylic ester monomers include acrylic esters such as methyl acrylate, butyl acrylate, isobutyl acrylate, propyl acrylate, octyl acrylate, dodecyl acrylate, lauryl acrylate, 2-ethylhexyl acrylate, stearyl acrylate, 2-chloroethyl acrylate, phenyl acrylate, and methyl α-chloroacrylate; and methacrylic esters such as methyl methacrylate, ethyl methacrylate, propyl methacrylate, butyl methacrylate, isobutyl methacrylate, octyl methacrylate, dodecyl methacrylate, lauryl methacrylate, 2-ethylhexyl methacrylate, stearyl methacrylate, phenyl methacrylate, dimethylaminoethylmethacrylate and diethylaminoethyl methacrylate.

Polyester resins, epoxy resins and polyol resins can be used as the resin for the toner of the present invention. Polyhydric alcohols constituting the polyester resins include adducts of bisphenol A with ethylene oxide, adducts of bisphenol A with propylene oxide, ethylene glycol, 1,2-propylene glycol, 1,4-butanediol, 1,5-pentanediol, 1,6-hexanediol, neopentyl glycol, diethylene glycol, triethylene glycol, polyethylene glycol, polytetramethyleneglycol, 1,4-cyclohexanedimethanol, and alcohols having 3 or more hydroxy groups such as trimethylolpropane and pentaerythritol. Polycarboxylic acids constituting the polyester resins include terephthalic acid, isophthalic acid, isophthalic acid, orthophthalic acid, 2,6-naphthalenedicarboxylic acid, paraphenylenedicarboxylic acid, 1,4-cyclohexanedicarboxylic acid, succinic acid, glutaric acid, adipic acid, suberic acid, azelaic acid, sebacic acid, dodecanedioic acid, and acids having 3 or more carboxyl groups such as trimellitic acid and pyromellitic acid. When polyhydric alcohol having 3 or more hydroxy groups and polycarboxylic acid having 3 or more carboxyl groups are used, the resultant resins can be crosslinked and the resultant toner tends to have an advantage of good resistance to offset.

Suitable epoxy resins and polyol resins for use in the toner of the present invention include resins which are manufactured using materials such as products of bisphenol A and epichlorohydrin, glycidyl esters of polyols and glycidyl esters of polyacids.

The toner of the present invention can be manufactured by any known method, but when the following method is used, toners can be manufactured by continuous production processes, and thereby low-cost toners can be produced.

When the primary particles employed in the manufacture of the toner of the present invention are manufactured by a pulverizing method without using a charge controlling agent, benefits are obtained in manufacturing costs of the resultant toner. In addition, when a charge controlling agent is present in the block to be pulverized such that the charge controlling agent is distributed interfacially between the resultant pulverized particles when the block is pulverized, it is difficult to pulverize the particles, which means that it takes a long time to pulverize the particles or a large facility is needed for the pulverizing operation, which is a disadvantage. In this case, pulverizing assisting agents such as fluidizing agents, organic or inorganic pigments, and magnetic materials, which are mentioned above and which do not adversely affect the resultant toner, are preferably added to the primary particles to improve the pulverization problem.

Another method is to add a composition including a charge controlling agent to the primary particles and then fix the composition to the surface of the primary particles. By using this method, the resultant toner does not include projections, which have weak physical properties, on the surface of the primary particles and in addition the toner has proper charge properties suitable for electrophotography.

In the present invention, the following method, which is known, for manufacturing toners for electrophotography can be used:

(1) preparing primary particles at least including a resin and a colorant;

(2) dispersing the particles in a liquid, which does not dissolve the resin and which includes a dispersant, to prepare a dispersion of the particles;

(3) heating and then cooling the dispersion;

(4) washing the particles, if desired; and (5) obtaining the toner particles after drying the liquid. In the present invention, a composition including a charge controlling agent is preferably added to the particles before the heating, during the heating, after the cooling or after the washing.

By using this method, the composition including a charge controlling agent is fixed on the surface part of the primary particles. Therefore, a toner which does not have projections, which has weak physical properties, on the surface thereof and has good charge properties can be manufactured.

In addition, in this method the heating is preferably performed for about 30 minutes or less at a temperature which is near the softening point of the resin and which is lower than a temperature which is higher than the softening point of the resin by about 30° C. By thus properly controlling the heating temperature and the heating time in the manufacturing processes of the toner, a toner haying good transferability, good clearing properties and good image reproducibility can be obtained.

Further, by adding an organic solvent, which dissolves or swells the resin in the primary particles, to the liquid which includes a dispersant and which does not dissolve the resin, the temperature of the heating can be lowered, resulting in prevention of the formation of aggregates caused by adhesion of the primary particles; thereby producing the toner in high yield. This method is particularly effective for manufacturing a monochrome toner in which primary particles having a relatively high melt viscosity are used to widen the fixing temperature of the resultant toner.

Furthermore by using, as the primary particles, a mixture which includes at least a resin, a colorant and a pulverizing assisting agent and which is prepared by kneading and then pulverizing the materials, pulverizability is improved and, therefore, the resultant toner can be manufactured at low cost. In general, when particles are pulverized after a pulverizing assisting agent is added to the particles, pulverizability is improved, but the resultant particles tend to become too brittle. However, by the treatment of the present invention, the resultant particles have good hardness and good mechanical strength, because the contact of the resin with the pulverizing assisting agent is improved in the primary particles.

Moreover, by using primary particles to which a fluidizing agent having the same charging polarity as that of the mother particles of the primary particles adheres, the resultant toner has good charge properties as well as good fluidity. It seems that a fluidizing agent having a polarity different from that of the mother particles is preferred, because the fluidizing agent securely adheres to the mother particles and can work well in the following treating processes. However, as found in research by the present inventor, the fluidizing agent having the same polarity exhibits good performance, in fact. The reason is that the fluidizing agent does not release from the mother particles when dispersed in the liquid and prevents the primary particles from adhering to each other and aggregating; and since the fluidizing agent is fixed on the surface of the mother particles, the resultant toner has good fluidity, and few reversely-charged particles, resulting in prevention of problems such as toner scattering and background fouling. Namely, it is believed that the interaction between the fluidizing agent and the mother particles is not caused by their charges, but is mainly caused by the van der Waals forces between them.

The toner of the present invention can also be effectively manufactured at low cost by continuous processes using a compact manufacturing apparatus which can work with low energy consumption and which includes the following zones:

(1) a first zone in which primary particles including at least a resin and a colorant are dispersed in a liquid including water;

(2) a second zone in which the dispersion is heated while flowing through the shape controlling second zone;

(3) a third zone in which a charge controlling agent composition and a release agent composition are fixed on the surface of the particles; and (4) a fourth zone in which the thus obtained particle dispersion is washed and then dried.

According to the present invention, a toner in which one or more charge controlling agent(s) is(are) securely fixed on the surface part of the toner particles and which can maintain good image qualities for a long time without causing contamination of carriers and developing units can be obtained by a manufacturing method which is industrially practical.

FIG. 1 is a flow chart of useful procedures for manufacturing an embodiment of the toner of the present invention. The toner manufacturing processes of the present invention are now explained in connection with the disclosure of FIG. 1.

1. Preparation of Primary Particles

Primary particles are prepared by dispersing toner property forming agents such as a colorant, a magnetic material, a charge controlling agent and a release agent, in a resin by a known method such as by pulverization. When the particles are manufactured by a pulverization technique, the primary particles are preferably manufactured without charge controlling agents, because the charge controlling agents are buried in the primary particles or released from the primary particles in the following processes.

The primary particles preferably have an average particle diameter and particle distribution close to those of the resultant toner particles. However, by using the method of the present invention, toners can be manufactured if the particle diameter and particle distribution of the primary particles are not in the ranges of the toner to be manufactured.

The shape of the primary particles is preferably irregular, because the shape is controlled in the shape controlling procedure mentioned below. However, there is no problem if spherical primary particles are used. If the primary particles include a volatile component, it can be removed in the shape controlling procedure mentioned below, but the volatile component is preferably removed before preparing the primary particles.

2. Mixing with Fluidizing Agent

Conventionally a fluidizing agent is mixed with toner host particles, which are classified, after a kneaded mixture of a resin and a colorant is pulverized. However, in the present invention a fluidizing agent is preferably adhered to primary particles and then the primary particles are subjected to the shape-controlling treatment mentioned later. By mixing a fluidizing agent with the primary particles before the shape controlling treatment, the fluidizing agent, which adheres to the surface of the primary particles, can be fixed thereto, and, in addition, fluidizing agent particles free from the primary particles can also be fixed to the surface of the primary particles.

Further the fluidizing agent can also prevent the aggregation of primary particles during the shape controlling treatment. The fluidizing agent can exert the effect even in an amount of 2% or less by weight to the primary particles. A large amount of the fluidizing agent should be avoided so as to avoid inclusion in the primary particles. In addition, the charging polarities of the fluidizing agent and the mother particles of the primary particles are preferably the same, thereby preparing a toner having good charge properties which can produce images having good image qualities.

3. Mixing with Shape Controlling Medium

The primary particles, which are previously mixed with a fluidizing agent if desired, are mixed and dispersed in a shape controlling medium. The shape controlling medium is preferably a liquid which does not dissolve the resin included in the primary particles, and the liquid may include an organic solvent which swells or dissolves the resin. In addition the medium may be an emulsion.

Specific examples of the medium include water, alcohols such as methanol and ethanol, ketones such as acetone, aromatic solvents such as benzene and toluene, paraffin type hydrocarbon such as n-hexane, halogenated hydrocarbons, and the like.

When a mixing liquid or an emulsion, which includes a liquid capable of swelling or dissolving the resin included in the primary particles, is used as the shape controlling medium, shape controlling of a toner, which includes a crosslinked component or a resin having a weight average molecular weight not less than a few hundred thousand, is possible. In addition, the primary particles can be easily dispersed in the medium and the heating temperature can be lowered. However, if a large amount of the mixed liquid or the emulsion is used, a large amount of drying energy is required and it takes a long time to dry the particles, resulting in increases in manufacturing costs.

The shape controlling medium preferably includes a dispersant to wet the primary particles and to disperse the particles such that each primary particle is dispersed while separating from the other particles. Preferably, the dispersant is previously dispersed or dissolved in the shape controlling medium.

4. Shape Controlling Treatment (Including Aggregating Treatment)

The primary particles are dispersed in the liquid including a dispersant and the resultant dispersion is stirred until the primary particles are sufficiently wet and dispersed. Then the dispersion is heated at a temperature in the neighborhood of the softening point of the resin to control the shape of the primary particles, while the dispersion is softly stirred to prevent the primary particles from precipitating or floating.

The heating is preferably performed for 5 minutes or more at a target temperature. The shape is determined depending on the heating temperature and the heating time. Even when the heating is performed for a long time, a desired shape cannot be obtained if the heating temperature is low.

When the primary particles have a particle diameter distribution in which relatively small particles are present in excess of the desired amount, the distribution can be reformed by selecting the small particles, aggregating the particles and then melting the particles. For example, aggregation can be performed by heating the particles at a temperature suitable for aggregating the particles, by applying mechanical energy to the particles, by utilizing ionic forces of the particles or by swelling the particles with a solvent. By using these methods, toner particles can be obtained without classification, resulting in reduction of the cost of manufacturing processes.

5. Addition of Charge Controlling Agent Composition

The charge controlling agents are preferably fixed on the surface part of the primary particles. When the charge controlling agents are dispersed inside the primary particles or merely adhered to the surface of the primary particles, good charge properties cannot be obtained.

The charge controlling agents can be fixed on the surface part of the primary particles, for example, by one of the following methods:

(1) Mixing primary particles and a composition including one or more charge controlling agents in a dry process and then dispersing the particles in a liquid to perform the shape controlling treatment, resulting in fixation of the charge controlling agents on the surface part of the primary particles; and (2) Mixing a composition including one or more charge controlling agents with a dispersion including the primary particles after the particles are dispersed in a liquid including water or after the dispersion is subjected to a heat treatment, and then fixing the charge controlling agent to the particles, which can be accomplished by one of the following processes known in toner manufacture.

In this case, by including a solvent in the liquid, which dissolves or swells the resin in the primary particles, fixation can be further improved. The composition including charge controlling agents preferably includes a solvent, which can dissolve the charge controlling agent and is compatible with the shape controlling medium, which does not dissolve the charge controlling agents. By mixing the composition with the dispersion of the primary particles, the charge controlling agents can be dispersed therein as fine particles whose particle diameter is not greater than about 1 $\mu$m, and preferably not greater than about 0.1 $\mu$m. The thus obtained particulate charge controlling agents can be securely fixed to the surface part of the particles by van der Waals forces or by electrostatic force and, therefore, contamination of carrier particles or developing units can be avoided even when the resultant toner is used over a long period of time.

When charge controlling agents are present in the primary particle dispersion in the shape controlling process mentioned above, the charge controlling agents can unite with the resin which is present at the surface part of the particles and, therefore, the charge controlling agents can be securely fixed thereon. Stabilizers, resins, and inorganic or organic particles can be added to the dispersion to stably disperse the charge controlling agents in the dispersion.

6. Cooling

The dispersion is then cooled to a temperature less than the softening point of the resin, preferably to room temperature. By controlling the cooling speed, crystallization of the resin or the wax included in the particles can be controlled and thereby the fixability and preservability of the resultant toner can be controlled.

7. Classification Treatment

When the particles obtained have a relatively wide particle distribution even after the shape controlling treatment, the particles are classified to a desired particle size distribution. The classification can be performed with a cyclone, a decanter, a centrifuge or the like and relatively fine particles are removed from the dispersion. Needless to say, the particles can be classified after the particles are dried, however, the classification of the particles in the dispersion is preferred from the viewpoint of efficiency. The unwanted particles, such as fine particles or coarse particles, can be reused for formation of the primary particles. When a resin and a pigment are kneaded to prepare primary particles, the fine particles or coarse particles obtained in the classification process can be added thereto. In this case, the fine or the coarse particles may be in a dry or a wet state. The obtained fine particles can be converted to a toner by aggregation in the same way as mentioned above in the shape controlling treatment so that they have the desired particle diameter, resulting in increase of the yield of the toner.

8. Washing Treatment

The dispersant included in the dispersion is preferably removed from the dispersion when the classification treatment is performed. In addition, the dispersant which adheres to the resultant particles can also be removed by acid/alkali treatment or by an enzymatic decomposing operation.

9. Drying Treatment

The toner of the present invention can be obtained by drying the dispersion or cake-like particles including water with a conventional drying apparatus. Preferably drying is performed for a short time with a spray dryer, a belt dryer and a rotary kiln.

10. Surface Treatment

The thus obtained dry toner particles can be mixed with different types of particles such as a particulate release agent, a particulate charge controlling agent, a particulate fluidizing agent and a particulate colorant. By applying mechanical force to the mixture, these different particles can be fixed and unified with the surface of the toner particles and thereby the different particles are prevented from releasing from the resultant complex particles.

Methods useful for applying mechanical force include:

(1) Impacting the mixture rapidly-rotating blades;

(2) Discharging the mixture into a high speed airflow so that the particles of the mixture accelerate and collide with each other or the particles impact against a proper plate or some such object.

Specific examples of such apparatuses include an Ong Mill (manufactured by Hosokawa Micron Co., Ltd.), modified I type Mill in which pressure of air for pulverization is reduced (manufactured by Nippon Newmatic Co., Ltd.), Hybridization System (manufactured by Nara Machine Co., Ltd.), Kryptron System (manufactured by Kawasaki Heavy Industries, Ltd.), and automatic mortars.

The manufacturing process of the present invention is suitable for continuous production, because the treating time of each process is relatively short. That is, the prepared primary particles and the shape controlling medium including a dispersant are supplied to a mixer to prepare a dispersion. The prepared dispersion is then subjected to a heat treatment for a time on the order of minutes, while flowing through the shape controlling zone.

At this point, when the particulate charge controlling agent composition is added and the treatment is continued, the charge controlling agents can be fixed to the surface part of the particles. Then the classification treatment and washing treatment are performed at the same time, if desired, and the particles become a toner after passing through a drying zone. The charge controlling agent composition can be added just before the drying treatment and after the washing treatment. The fine particles and coarse particles removed by the classification treatment can be reused as toner products or primary particles by appropriately employing an aggregation treatment or a pulverization treatment. In addition, the shape controlling medium can be reused after the treatments are finished.

The toner of the present invention can be prepared by fixing a fluidizing agent and a charge controlling agent to the primary particles, which agents have adhered to the surface of the primary particles, in order to prevent release of these agents from the primary particles.

Free fluidizing agent particles and charge controlling agent particles tend to adversely affect image qualities by contaminating carriers and developing units, scratching photoconductors, and abrading cleaning blades. These free fluidizing agent and charge controlling agent materials can easily be observed with a scanning electron microscope. More precisely, the free fluidizing agent and charge controlling agent can be quantitatively determined by the following method:

(1) dispersing a toner in a liquid which does not dissolve the toner;

(2) separating the liquid from the toner; and (3) determining the quantity of the charge controlling agent and the fluidizing agent included in the liquid.

The determination of the quantity thereof can be performed by measuring the turbidity of the liquid or by detecting an element of the agents included in the liquid.

When a toner is manufactured by kneading and pulverizing operations, a colorant, a magnetic material, a charge controlling agent and a release agent are exposed on the surfaces of the resultant toner particles. Such toner constituting components tend to be easily released from the particles when, agitated in a developing unit and tend to contaminate the photoconductor and the carrier.

When a toner is manufactured by suspension polymerization or toner-solution-emulsifying methods, hydrophilic components in the toner tend to move to the interface between the particle and water, resulting in deterioration of the toner properties of the toner.

In the toner of the present invention, components of the toner other than the resin, which are present on the surface of the toner particles, are fixed thereto by heat treatment, resulting in prevention of the problems mentioned above.

The inside of a toner can be observed by a transmittance electron microscope after burying the toner in a resin, preparing an ultrathin section thereof, and dyeing with osmium or ruthenium, if desired. If there is a void in the toner particle, it can be identified by differences in contrast.

Having generally described this invention, a further understanding can be obtained by reference to certain specific examples which are provided herein for the purpose of illustration only and are not intended to be limiting. In the description in the following examples, the numbers represent weight ratios in parts, unless otherwise specified.

EXAMPLES

Example 1

The following components were mixed and kneaded with a three-roll kneading apparatus while heating:

| | |
|---|---|
| (i) Polyester resin (polycondensation product of terephthalic acid and adduct of bisphenol A with polyoxyethylene, softening point of 70° C.) | 100 |
| Copper phthalocyanine pigment | 3 |

The kneaded mixture was cooled and then crushed. The crushed mixture was pulverized with a jet mill, and then classified with an air classifier to remove fine particles. One hundred (100) parts of the thus obtained mother particles were mixed with 0.8 parts of a hydrophobic silica R972, which was manufactured by Nippon Aerosil Co., using a mixer to prepare primary particles.

Forty (40) parts of the primary particles were mixed into 100 parts of deionized water with sodium lauryl sulfate (dispersant) of 0.1% while stirring, and then the stirring was continued for 10 minutes.

After stirring, it was visually observed that there were no floating particles on the surface of the dispersion and the primary particles were perfectly wet in the dispersion. In addition, it was observed with a microscope that each primary particle was dispersed while separating from each other.

The thus obtained dispersion was subjected to centrifugation and then the supernatant liquid was removed. Deionized water, whose amount was the same as that of the removed supernatant liquid, was added to the primary particles and then the particles were dispersed again. This washing operation was repeated three times to prepare a refined dispersion of the primary particles.

On the other hand, 0.3 parts of the zinc salt of di-t-butylsalicylic acid (charge controlling agent (a)) were dissolved in 20 parts of methanol to prepare a solution of the charge controlling agent (a), and then 20 parts of deionized water were dropped into the solution to prepare a dispersion in which di-t-butylsalicylic acid zinc salt was finely dispersed.

The thus obtained dispersion of di-t-butylsalicylic acid zinc salt was added to the primary particle dispersion while stirring, and further ultrasonically dispersed using an ultrasonic probe. The dispersion was heated from the outside of the container with hot water while the dispersion was being stirred, to increase the temperature of the dispersion to 50° C. After being kept at 50° C. for 10 minutes while stirring, the dispersion was cooled to 20° C. The dispersion was dried to prepare a toner with a spray dryer GS31 manufactured Yamato Kagaku K.K. under the conditions that the temperature of the hot air was 80° C. and the temperature at the exit of the dryer was 50° C.

Five (5) parts of the thus obtained toner were mixed with 100 parts of a ferrite carrier which was coated with a silicone resin in a thickness of 0.3 $\mu$m and whose average particle diameter was 50 $\mu$m, to prepare a developer. The developer was evaluated by the methods mentioned below.

In addition, the saturated charge quantity of the mother particles was −8 $\mu$C/g, when measured in the combination with the carrier, and the saturated charge quantity of the hydrophobic silica R972 was −125 $\mu$C/g, when measured in the combination with the carrier, which was the same polarity as that of the mother particles.

Comparative Example 1

The following components were mixed and kneaded with a three-roll kneading apparatus while heating:

| | |
|---|---|
| Polyester resin (polycondensation product of terephthalic acid and adduct of bisphenol A with polyoxyethylene, softening point of 70° C.) | 100 |
| Copper phthalocyanine pigment | 3 |
| Di-t-butylsalicylic acid zinc salt | 3 |

The kneaded mixture was cooled and then crushed. The crushed mixture was pulverized with a jet mill. The powder which adhered to the pulverizer was sampled and analyzed to determine the content of zinc therein. As a result, the content of zinc in the powder was about 50 times as much as that in the pulverized mixture. It was believed that the crushed particles were mainly pulverized at the places in which the charge controlling agent, i.e., di-t-butylsalicylic acid zinc salt, was present and, therefore, the charge controlling agent was mainly present on the surface of the pulverized particles.

The pulverized mixture was then classified with an air classifier to remove fine particles. One hundred (100) parts of the thus prepared powder were mixed with 0.8 parts of a hydrophobic silica R972, which was manufactured by Nippon Aerosil Co., using a mixer to prepare a toner.

A developer was prepared and then evaluated in the same way as performed in Example 1.

In Comparative Example 1, the content of the charge controlling agent in the toner was about 4 times as much as that in Example 1. This is because the charge properties of the toner were not satisfactory unless such a large amount of the charge controlling agent was used.

Example 2-1

The procedure for preparation of the primary particles in Example 1 was repeated to prepare primary particles.

Forty (40) parts of the primary particles were mixed into 100 parts of deionized water and 0.1% of sodium lauryl sulfate while stirring, and stirring was continued for 10 minutes.

After stirring, it was visually observed that there were no floating particles on the surface of the dispersion and the primary particles were perfectly wet in the dispersion. In addition, it was observed with a microscope that all primary particles were dispersed and separated from each other.

Further, the dispersion was heated from the outside of the container with hot water while the dispersion was being stirred, to increase the temperature of the dispersion (hereinafter referred to as the treatment temperature) to 60° C. After being kept at the treatment temperature for 10 minutes while stirring, the dispersion was cooled to 20° C. The dispersion was subjected to centrifugation and then the supernatant liquid was removed. Deionized water, whose amount was the same as that of the removed supernatant liquid, was added to the primary particles and then dispersed again. This washing operation was repeated three times to prepare a refined dispersion of the primary particles.

The following operations were performed in the same way as mentioned in Example 1 to prepare a toner and a developer. In addition, the developer was evaluated in the same way as mentioned in Example 1.

Example 2-2

The procedures for preparation and evaluation of the developer in Example 2-1 were repeated except that the treatment temperature was changed to 70° C.

Example 3-1

The procedure for preparation of the primary particles in Example 1 was repeated to prepare primary particles.

Forty (40) parts of the primary particles were mixed in 100 parts of deionized water containing 0.15% polyoxyethylenesorbitan monooleate (tradename of Tween 80) while stirring, and then the stirring was continued for 10 minutes.

After stirring, it was visually observed that there were no floating particles on the surface of the dispersion and the primary particles were perfectly wet in the dispersion. In addition, it was observed with a microscope that all primary particles were dispersed and separated from each other.

Further, the dispersion was heated from the outside of the container with hot water while the dispersion was being stirred, at a treatment temperature of 60° C. After being kept at the treatment temperature for 10 minutes, the dispersion was cooled to 20° C. The dispersion was subjected to centrifugation and then the supernatant liquid was removed. Deionized water, whose amount was the same as that of the removed supernatant liquid, was added to the primary particles and then dispersed again. This washing operation was repeated three times to prepare a refined dispersion of the primary particles.

On the other hand, 0.2 parts of a quaternary ammonium salt having a perfluoro group, NX-VP434 manufactured by Hoechst AG., were dissolved in 20 parts of methanol to prepare a solution of the charge controlling agent (b) and then 20 parts of deionized water were dropped into the solution to prepare a dispersion in which the charge controlling agent (b) was finely dispersed.

The thus prepared dispersion of NX-VP434 was added to the primary particle dispersion while stirring, and further ultrasonically dispersed for 5 minutes using an ultrasonic probe. The dispersion was heated from the outside of the container with hot water while the dispersion was being stirred, to increase the temperature of the dispersion to 50° C. After being kept at 50° C. for 10 minutes while stirring, the dispersion was cooled to 20° C. The dispersion was dried with a spray dryer GS31 manufactured Yamato Kagaku K.K. to prepare a toner under the conditions that the temperature of the hot air was 80° C. and the temperature at the exit of the dryer was 50° C.

Five (5) parts of the thus prepared toner were mixed with 100 parts of a ferrite carrier which was coated with a silicone resin in an average thickness of 0.3 $\mu$m and whose average particle diameter was 50 $\mu$m, to prepare a developer.

The developer was evaluated in the same way as mentioned in Example 1.

Example 3-2

The procedures for preparation and evaluation of the developer in Example 3-1 were repeated except that the treatment temperature was changed to 70° C.

Comparative Example 2

The following components were mixed and kneaded with a three-roll kneading apparatus while heating:

| | |
|---|---|
| Polyester resin (polycondensation product of terephthalic acid and adduct of bisphenol A with polyoxyethylene, softening point of 70° C.) | 100 |
| Copper phthalocyanine pigment | 3 |
| NX-VP434 | 2 |

The kneaded mixture was cooled and then crushed. The crushed mixture was pulverized with a jet mill. The powder which adhered to the pulverizer was sampled and analyzed to determine the content of fluorine therein. As a result, the content of fluorine in the powder was about 35 times as much as that in the pulverized mixture. It was believed that the crushed particles were mainly pulverized at the places in which the charge controlling agent, NX-VP434, was present and, therefore, the charge controlling agent was mainly present on the surface of the pulverized particles.

The pulverized mixture was then classified with an air classifier to remove fine particles. One hundred (100) parts of the thus obtained powder were mixed with 0.8 parts of a hydrophobic silica using a mixer to prepare a toner.

A developer was prepared and then evaluated in the same way as performed in Example 1.

In Comparative Example 2, the content of the charge controlling agent in the toner was about 4 times as much as that in Example 3-1.

Example 4-1

The procedure for preparation of the primary particles in Example 1 was repeated to obtain primary particles.

Forty (40) parts of the primary particles were mixed into 100 parts of deionized water containing 0.1% sodium lauryl sulfate while stirring, and then the stirring was continued for 10 minutes.

After the stirring, it was visually observed that there were no floating particles on the surface of the dispersion and the primary particles were perfectly wet in the dispersion. In addition, it was observed with a microscope that all the primary particles were dispersed and were separated from each other.

Further, the dispersion was heated from the outside of the container with hot water while the dispersion was being stirred, at a treatment temperature of 60° C. After being kept at the treatment temperature for 10 minutes while stirring, the dispersion was cooled to $_{20}$0° C. The dispersion was subjected to centrifugation and then the supernatant liquid was removed. Deionized water whose amount was the same as that of the removed supernatant liquid was added to the primary particles and then dispersed again. This washing operation was repeated three times to prepare a refined dispersion of the primary particles.

On the other hand, 0.3 parts of di-t-butylsalicylic acid zinc salt and 0.2 parts of a quaternary ammonium salt having a perfluoro group, NX-VP434 manufactured by Hoechst AG., were dissolved in 20 parts of methanol to prepare a solution of the charge controlling agents (a) and (b) and then 20 parts of deionized water were dropped into the solution. The solution was slightly cloudy but no particles in the liquid were observed with a microscope. It was believed that the particle diameter of the particles of the charge controlling agents dispersed therein was on the order of submicrons.

The thus obtained dispersion of di-t-butylsalicylic acid zinc salt and NX-VP434 was added to the primary particle dispersion while stirring, and further ultrasonically dispersed using en ultrasonic probe. The dispersion was treated from the outside of the container with hot water while the dispersion was being stirred, to increase the temperature of the dispersion to 50° C. After being kept at 50° C. for 10 minutes while stirring, the dispersion was cooled to 20° C. The dispersion was dried to prepare a toner with a spray dryer GS31 manufactured Yamato Kagaku K.K. under the conditions that the temperature of the hot air was 80° C. and the temperature at the exit of the dryer was 50° C.

A developer was prepared and evaluated in the same way as mentioned in Example 1.

Example 4-2

The procedures for preparation and evaluation of the developer in Example 4-1 were repeated except that the treatment temperature was changed to 700° C.

Comparative Example 3

The following components were mixed and kneaded with a three-roll kneading apparatus while heating:

| | |
|---|---|
| Polyester resin (polycondensation product of terephthalic acid and adduct of bisphenol A with polyoxyethylene, softening point of 70° C.) | 100 |
| Copper phthalocyanine pigment | 3 |
| di-t-butylsalicylic acid zinc salt | 3 |
| NX-VP434 | 2 |

The kneaded mixture was cooled and then crushed. The crushed mixture was pulverized with a jet mill.

The pulverized mixture was then classified with an air classifier to remove fine particles. One hundred (100) parts of the thus obtained powder were mixed with 0.8 parts of a hydrophobic silica using a mixer to prepare a toner.

A developer was prepared and then evaluated in the same way as performed in Example 1.

In Comparative Example 3, the content of the charge controlling agent in the toner was about 4 times as much as that in Example 4-1.

Example 5

The following components were mixed and kneaded with a two-roll kneading apparatus while heating:

| | |
|---|---|
| Partially-crosslinked styrene-n-butyl methacrylate copolymer (softening point of 75° C.) | 100 |
| carbon black | 10 |
| Low-molecular-weight polypropylene | 5 |

The kneaded mixture was cooled and then crushed. The crushed mixture was pulverized with a jet mill, and then classified with an air classifier to remove fine particles. One hundred (100) parts of the thus obtained mother particles were mixed with 0.5 parts of a hydrophobic silica R972 using a mixer to prepare primary particles.

Twenty five (25) parts of the primary particles were mixed into 100 parts of deionized water with partially-saponified polyvinyl alcohol of 0.5% while stirring, and then the stirring was continued for 10 minutes.

After the stirring, it was visually observed that there were no floating particles on the surface of the dispersion and it was observed with a microscope that all primary particles were dispersed and separated from each other.

In addition, 20 parts of a solvent in which deionized water and methyl ethyl ketone were mixed in a ratio of 4/1 were gradually added to the dispersion while stirring.

On the other hand, 0.3 parts of BONTRON S-34 (metal-containing azo dye type charge controlling agent, manufactured by Orient Chemical Industries CO., Ltd.) were added to 20 parts of methanol to obtain a solution of the charge controlling agent. This solution was added to the dispersion of the primary particles, and the dispersion was heated from the outside of the container with hot water while the dispersion was being stirred, to increase the temperature of the dispersion to 80° C. After being kept at 80° C. for 10 minutes while stirring, the dispersion was cooled to 20° C.

When the dispersion was filtered with a sieve of 400 mesh, after the shape controlling treatment mentioned above, all particles of the dispersion passed through the sieve and aggregated particles could not be observed. The dispersion was refined by repeating the operations three times in which the dispersion was subjected to centrifugation treatment, the supernatant was removed therefrom, and further the residue was dispersed again with deionized water whose amount was the same as that of the removed supernatant liquid. The refined dispersion was filtered by means of suction and then dried in an oven at 40° C. until the weight of the filtered particles was constant. The thus obtained particles were separated from each other with a mixer to obtain a toner of the present invention.

A developer was prepared and evaluated in the same way as mentioned in Example 1. The saturated charge quantity of the mother particles was −12 $\mu$C/g when measured in combination with the carrier, and the saturated charge quantity of the hydrophobic silica R972 was −125 $\mu$C/g, which was the same polarity as that of the mother particles.

Comparative Example 4

The following components were mixed and kneaded with a two-roll kneading apparatus while heating;

| | |
|---|---|
| Partially-crosslinked styrene-n-butyl methacrylate copolymer (softening point of 75° C.) | 100 |
| carbon black | 10 |
| Low-molecular-weight polypropylene | 5 |
| BONTRON S-34 | 3 |

The kneaded mixture was cooled and then crushed. The crushed mixture was pulverized with a jet mill, and then classified with an air classifier to remove fine particles. One hundred (100) parts of the thus obtained powder were mixed with 0.5 parts of a hydrophobic silica R972 using a mixer to prepare a toner.

A developer was prepared and evaluated in the same way as mentioned in Example 1.

In Comparative Example 4, the content of the charge controlling agent in the toner was about 2.5 times as much as that in Example 5.

Example 6

The procedure for preparation of the primary particles in Example 5 was repeated except that 3 parts of titanium oxide (fluidizing agent), which was subjected to hydrophobic treatment, were added to the mixture of the resin, the carbon black and the low-molecular-weight polypropylene before kneading.

When the quantity of each crushed mixture obtained in Examples 5 and 6 fed to the pulverizing process was measured, which was suitable for pulverizing the mixture so as to have a targeted volume average particle diameter (7.5 μm), the quantity in Example 6 fed was greater by about 2.5 times than that in Example 5.

The following operations were performed in the same way as mentioned in Example 5 to prepare a toner and a developer. The developer was evaluated in the same way as mentioned in Example 1.

Comparative Example 5

The procedure for the preparation of the primary particles in Example 5 was repeated except that the hydrophobic silica was replaced with a silica whose surface had been treated with a silane coupling agent including an amino group.

The following operations were performed in the same way as performed in Example 5 to prepare a toner and a developer. When the dispersion was filtered with a sieve of 400 mesh after the shape controlling treatment, the weight of the aggregate on the sieve was 35% of that of the total primary particles, which was different from the result in Example 5.

The charge quantity of the silica treated with a silane coupling agent including an amino group was +65 μC/g, when measured in combination with the carrier, which had the polarity opposite to that of the mother particles.

The toners and the developers prepared in Examples 1–6 and Comparative Examples 1–5 were evaluated with respect to the following items. The measuring methods for the items (1)–(4) are described above and, therefore, are not again explained.

(1) Saturated charge quantity (2) Confirmation whether charge controlling agents are present on the surface part of the toner particles (3) Carrier contamination degree (4) Average spherical degree (5) Stability of charge property Each developer of Examples 1, 2-1, 2-1, 3-1, 3-2, 4-1, and 4-2, and Comparative Examples 1, 2, and 3 was set in a full color copier, Preter 550 manufactured by Ricoh Co., Ltd., and a running test was performed in which 10,000 copies were reproduced. A digital copier, Imagio DA-250 manufactured by Ricoh Co., Ltd., was used for the running test of the developers of Examples 6 and 7, and Comparative Examples 4 and 5.

The difference between the charge quantity (Q/m) of the toner in each developer before the running test and that after the running test was determined. When the difference is not greater than 5 μC/g, the stability of the charge property is good.

(6) Fogging of Images

Images was observed using a magnifying glass to determine whether there was fogging in the images.

The fogging was classified as follows:

Rank 5: No fogging could be observed in the images during the test.

Rank 4: Fogging could be observed in the image from the late running test.

Rank 3: Fogging could be continuously observed in the images from the middle running test.

Rank 2: Fogging could be continuously observed in the image from the early running test.

Rank 1: Fogging could be continuously observed in the images from the start of the running test.

(7) Omissions in Recorded Character Images

Character images were observed using a magnifying glass to determine whether there were any omissions in the recorded character images.

The omissions in the recorded character images were classified as follows:

Rank 5: No omission could be seen in the images.

Rank 4: Few omissions could be seen in the images.

Rank 3: A few omissions could be seen in the images.

Rank 2: many omissions could be seen in the images.

Rank 1: Extremely many o missions could be seen in the images.

The results are shown in Table 1.

| | Evaluation Items | | | | | | |
|---|---|---|---|---|---|---|---|
| | (1) μC/g | (2) | (3) % | (4) | (5) μC/g | (6) | (7) |
| Example 1 | 30 | present | 16 | 125 | 1 | rank 3 | rank 2 |
| Example 2-1 | 27 | present | 12 | 113 | 2 | rank 4 | rank 4 |
| Example 2-2 | 31 | present | 7 | 104 | 0 | rank 5 | rank 5 |
| Example 3-1 | 18 | present | 11 | 111 | 3 | rank 4 | rank 4 |
| Example 3-2 | 17 | present | 5 | 102 | 1 | rank 5 | rank 5 |
| Example 4-1 | 25 | present | 10 | 116 | 0 | rank 4 | rank 4 |
| Example 4-2 | 22 | present | 0 | 105 | 3 | rank 5 | rank 5 |
| Example 5 | 27 | present | 9 | 112 | 0 | rank 4 | rank 4 |
| Example 6 | 21 | present | 9 | 108 | 3 | rank 5 | rank 5 |
| Comparative Example 1 | 28 | present (many) | 48 | 128 | 11 | rank 2 | rank 5 |
| Comparative Example 2 | 21 | present (many) | 63 | 130 | 16 | rank 3 | rank 2 |
| Comparative Example 3 | 26 | present (many) | 51 | 121 | 17 | rank 3 | rank 2 |
| Comparative Example 4 | 45 | present (many) | 44 | 134 | 20 | rank 3 | rank 2 |
| Comparative Example 5 | 9 | present | 82 | 119 | 19 | rank 2 | rank 1 |

The results shown in Table 1 clearly indicate that the toners of the present invention can maintain good charge properties and produced good images even when used over a long period of time.

This application is based on Japanese Patent Application No. 09-274542, filed on Oct. 7, 1997, incorporated therein by reference.

Having now fully described the invention, it will be apparent to one of ordinary skill in the art that many changes and modifications can be made thereto without departing from the spirit and scope of the invention as set forth therein.

What is claimed is:

1. A method for manufacturing a toner for eletrophotography, comprising the steps of:

preparing primary particles of the toner prepared by dispersing at least a colorant in a solid resin;

adhering a fluidizing agent to the primary particles, wherein when the fluidizing agent is mixed with a carrier coated with a silicone resin and then stirred, the fluidizing agent has a frictional charge which has the same polarity as the polarity of a frictional charge of the primary particles without the fluidizing agent when the primary particles without the fluidizing agent are mixed with the carrier coated with the silicone resin and then stirred;

dispersing the primary particles in a liquid, which does not dissolve the resin and which comprises a dispersant, to prepare a dispersion;

heating the dispersion;

cooling the dispersion;

optionally washing the dispersion; and drying the dispersion to prepare the toner, wherein a composition comprising a charge controlling agent is mixed with the primary particles at a time before the heating, during the heating, after the cooling or after the washing of the particles.

2. The method according to claim 1, wherein the liquid further comprises an organic solvent which swells or dissolves the resin.

3. The method according to claim 1, wherein the primary particles further comprise a pulverizing assisting agent and wherein the primary particles are prepared by the substeps of kneading the resin, the colorant and the pulverizing assisting agent to prepare a kneaded mixture; and pulverizing the kneaded mixture to prepare the primary particles.

4. A method for continuously manufacturing a toner for electrophotography, comprising the steps of:

preparing primary particles of the toner prepared by dispersing at least a colorant in a solid resin;

dispersing the primary particles in a liquid which contains water as a component in a first zone to prepare a dispersion;

heating the dispersion as it flows through a particle shape controlling second zone;

fixing a charge controlling agent and a fluidizing agent, wherein when the fluidizing agent is mixed with a carrier coated with a silicone resin and then stirred, the fluidizing agent has a frictional charge which has the same polarity as the polarity of a frictional charge of the primary particles without the fluidizing agent when the primary particles without the fluidizing agent are mixed with the carrier coated with the silicone resin and then stirred, to the primary particles dispersed in the dispersion in a third zone; and drying the dispersion in a fourth zone to prepare the toner.

5. A method for manufacturing a toner for electrophotography, comprising the steps of:

preparing primary particles of the toner prepared by dispersing at least a colorant in a solid resin having a softening point;

dispersing the primary particles in a liquid, which does not dissolve the resin and which comprises a dispersant, to prepare a dispersion;

heating the dispersion for no longer than about 30 minutes at a temperature which is near the softening point of the resin and which is lower than a temperature which is higher by about 30° C. than the softening point of the resin;

cooling the dispersion;

optionally washing the dispersion; and drying the dispersion to prepare the toner, wherein a composition comprising a charge controlling agent is mixed with the primary particles at a time before the heating, during the heating, after the cooling or after the washing of the particles.

6. The method according to claim 5, wherein the liquid further comprises an organic solvent which swells or dissolves the rest.

7. The method according to claim 5, wherein the primary particles further comprise a pulverizing assisting agent and wherein the primary particles are prepared by the substeps of kneading the resin, the colorant and the pulverizing assisting agent to prepare a kneaded mixture; and pulverizing the kneaded mixture to prepare the primary particles.

8. A method for continuously manufacturing a toner for electrophotography, comprising the steps of:

preparing primary particles of the toner prepared by dispersing at least a colorant in a solid resin having a softening point;

dispersing the primary particles in a liquid which contains water as a component in a first zone to prepare a dispersion;

heating the dispersion for no longer than about 30 minutes at a temperature which is near the softening point of the resin and which is lower than a temperature which is higher by about 30° C. than the softening point of the resin as it flows through a particle shape controlling second zone;

fixing a charge controlling agent and optionally a fluidizing agent on a surface part of the primary particles dispersed in the dispersion in a third zone; and drying the dispersion in a fourth zone to prepare the toner.

* * * * *

UNITED STATES PATENT AND TRADEMARK OFFICE

CERTIFICATE OF CORRECTION

PATENT NO. : 6,632,579 B1
DATED : October 14, 2003
INVENTOR(S) : Yamashita

It is certified that error appears in the above-identified patent and that said Letters Patent is hereby corrected as shown below:

Title page,
Item [45], should read as follows:

-- [45] **Date of Patent: *Oct. 14, 2003** --

Signed and Sealed this

Seventeenth Day of February, 2004

JON W. DUDAS
*Acting Director of the United States Patent and Trademark Office*